US009807509B2

(12) United States Patent
Mao et al.

(10) Patent No.: US 9,807,509 B2
(45) Date of Patent: Oct. 31, 2017

(54) SPEAKER

(71) Applicants: Lubin Mao, Shenzhen (CN); Hongxing Wang, Shenzhen (CN); Jiwei Ge, Shenzhen (CN)

(72) Inventors: Lubin Mao, Shenzhen (CN); Hongxing Wang, Shenzhen (CN); Jiwei Ge, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/061,171

(22) Filed: Mar. 4, 2016

(65) Prior Publication Data

US 2017/0034627 A1 Feb. 2, 2017

(30) Foreign Application Priority Data

Jul. 31, 2015 (CN) ..... 2015 2 0572474 U

(51) Int. Cl.

| | |
|---|---|
| ***H04R 9/02*** | (2006.01) |
| *H04R 9/04* | (2006.01) |
| *H04R 7/04* | (2006.01) |
| *H04R 9/06* | (2006.01) |
| *H04R 31/00* | (2006.01) |

(52) U.S. Cl.

CPC ..... *H04R 9/025* (2013.01); *H04R 7/04* (2013.01); *H04R 9/045* (2013.01); *H04R 9/047* (2013.01); *H04R 9/063* (2013.01); *H04R 31/006* (2013.01); *H04R 2209/022* (2013.01); *H04R 2499/11* (2013.01)

(58) Field of Classification Search

CPC . H04R 9/06; H04R 9/025; H04R 1/00; H04R 2499/11; H04R 7/02; H04R 7/04

See application file for complete search history.

(56) References Cited

U.S. PATENT DOCUMENTS

2004/0086145 A1* 5/2004 Stiles ..... H04R 9/025 381/412

2011/0255711 A1* 10/2011 Ivey ..... H04R 1/028 381/104

* cited by examiner

*Primary Examiner* — Matthew Eason

(74) *Attorney, Agent, or Firm* — Na Xu; IPro, PLLC

(57) ABSTRACT

A speaker is provided in the present disclosure. The speaker includes a shell, a magnetic system and a vibrating system received in the shell. The vibrating system includes a membrane module and a coil assembly connecting to the membrane module for driving the membrane module to vibrate. The magnetic system includes a first magnet module and a second magnet module. The first magnet module and the second magnet module are opposite to each other to form a magnetic gap, and the coil assembly is arranged in the magnetic gap. The coil assembly includes a coil and a coil support for supporting the coil. The first magnet module includes a pair of first grooves formed at two opposite edges thereof, the first grooves are adjacent to the membrane module and face the coil assembly.

14 Claims, 5 Drawing Sheets

SPEAKER

FIELD OF THE DISCLOSURE

The present disclosure relates to electro-acoustic converting technologies, and more particularly, to a speaker for producing audible sound.

BACKGROUND

Speakers are widely applied in mobile devices, such as mobile phones, tablet computers, laptop computers, portable game player, portable multimedia devices, or the like, for converting electrical signals into audible sounds. A related speaker includes a vibration system, a magnetic system, and a holder for holding the vibration system and the magnetic system.

The magnetic system includes two opposite magnet module opposite to each other to form a magnetic gap. The vibrating system includes a membrane and a coil assembly connected to the membrane, the coil assembly includes a coil and a coil support for supporting the coil; the coil is located in the magnetic gap for driving the membrane to vibrate and produce sound.

However, in the above-described speaker, each of the first magnet module and the second magnet module normally includes several elongated magnets arranged in parallel. With this configuration, the magnetic gap merely has a limited space, and the coil support need to have a great length to meet a vibration amplitude requirement; this may cause a size of the speaker to be unduly large and inapplicable to a mobile device with a miniaturization requirement.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

FIG. 3 is a schematic view of an alternative magnetic system applicable to the speaker of FIG. 1;

DETAILED DESCRIPTION

The present disclosure will be described in detail below with reference to the attached drawings and the embodiment thereof.

Figure 1:
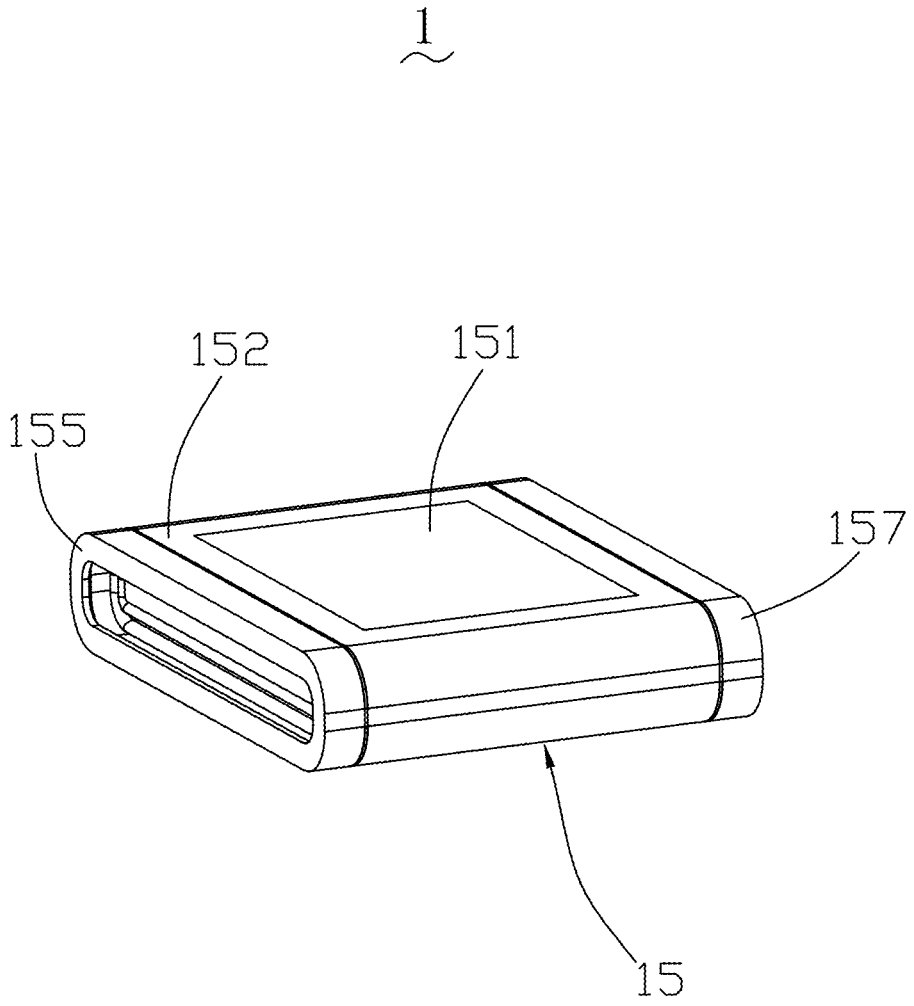
FIG. 1 is an assembled view of a speaker according to an embodiment of the present disclosure.
Figure 2:
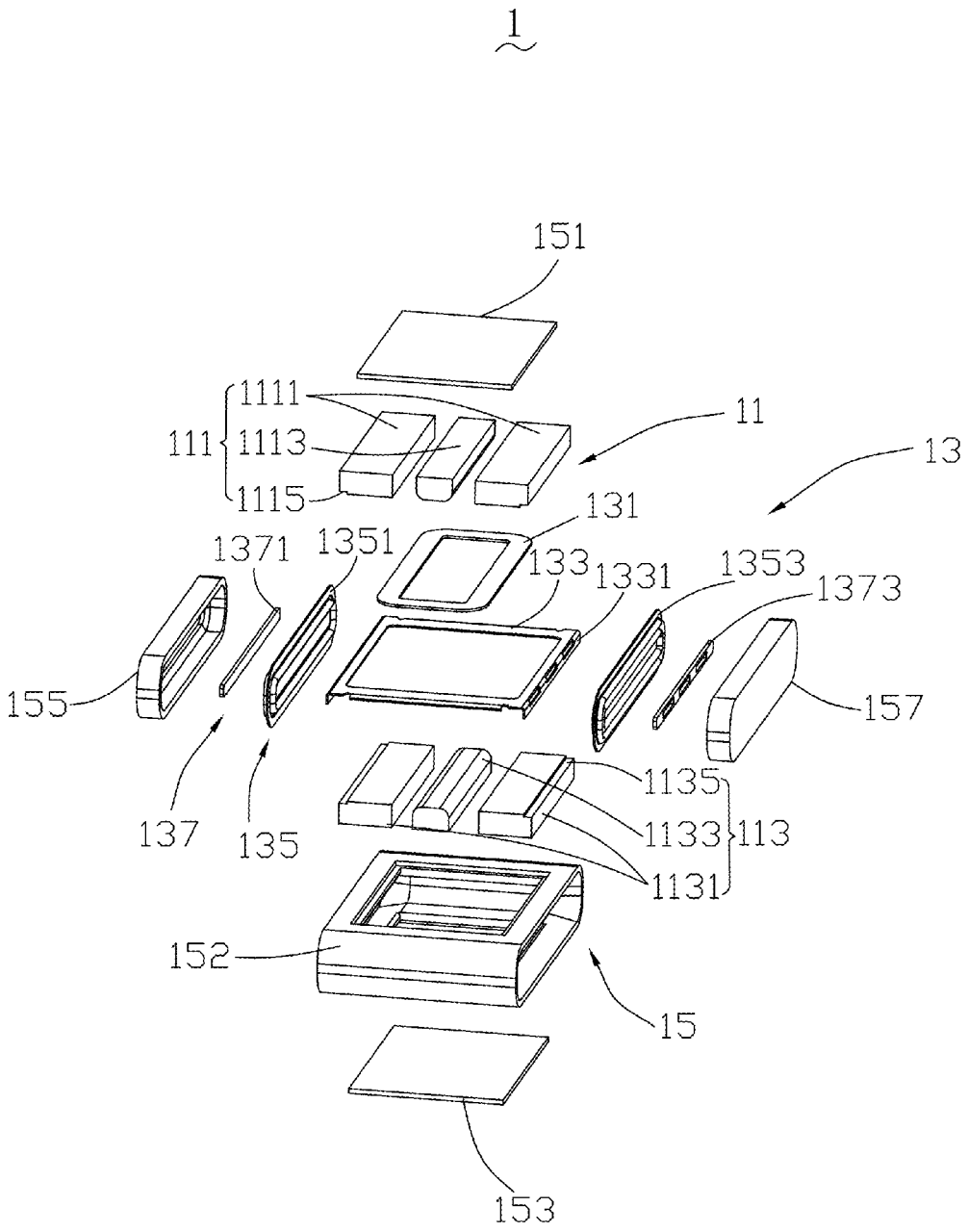
FIG. 2 is an exploded view of the speaker of FIG. 1.

Referring to FIGS. 1-2, a speaker 1 according to an embodiment of the present disclosure is shown. The speaker 1 includes a magnetic system 11, a vibrating system 13 and a shell 15. The vibrating system 13 and the magnetic system 11 are accommodated in the shell 15.

Specifically, the shell 15 includes a main frame 152, a first cover plate 151, a second cover plate 153, a front cover 157 and a rear cover 159. The main frame 152 provides a receiving cavity for receiving the vibrating system 13 and the magnetic system 11, and may be a hollow frame with two opposite openings. In the present embodiment, the two openings are aligned along a vibration direction of the vibrating system 13, and are defined as a front opening located at a front end of the main frame 152, and a rear opening located at a rear end of the main frame 152. The front end is engaged with the front cover 157, and the front cover 157 includes a sound outlet facing the front opening. The rear end is engaged with the rear cover 159, and is away from the sound outlet of the speaker 1.

The main frame 152 further includes a top plate with a top opening and a bottom plate with a bottom opening; the top plate and the bottom plate are opposite to each other and perpendicular to the vibration direction of the vibrating system 13. The first cover plate 151 and the second cover plate 153 are respectively provided to cover the top opening and the bottom opening of the main frame 152. In the present embodiment, the first cover plate 151 and the second cover plate 153 are detachable from the main frame 152, which is convenient for assembly and disassembly of speaker components (including the vibrating system 13 and the magnetic system 15) inside the shell 11.

Figure 5:
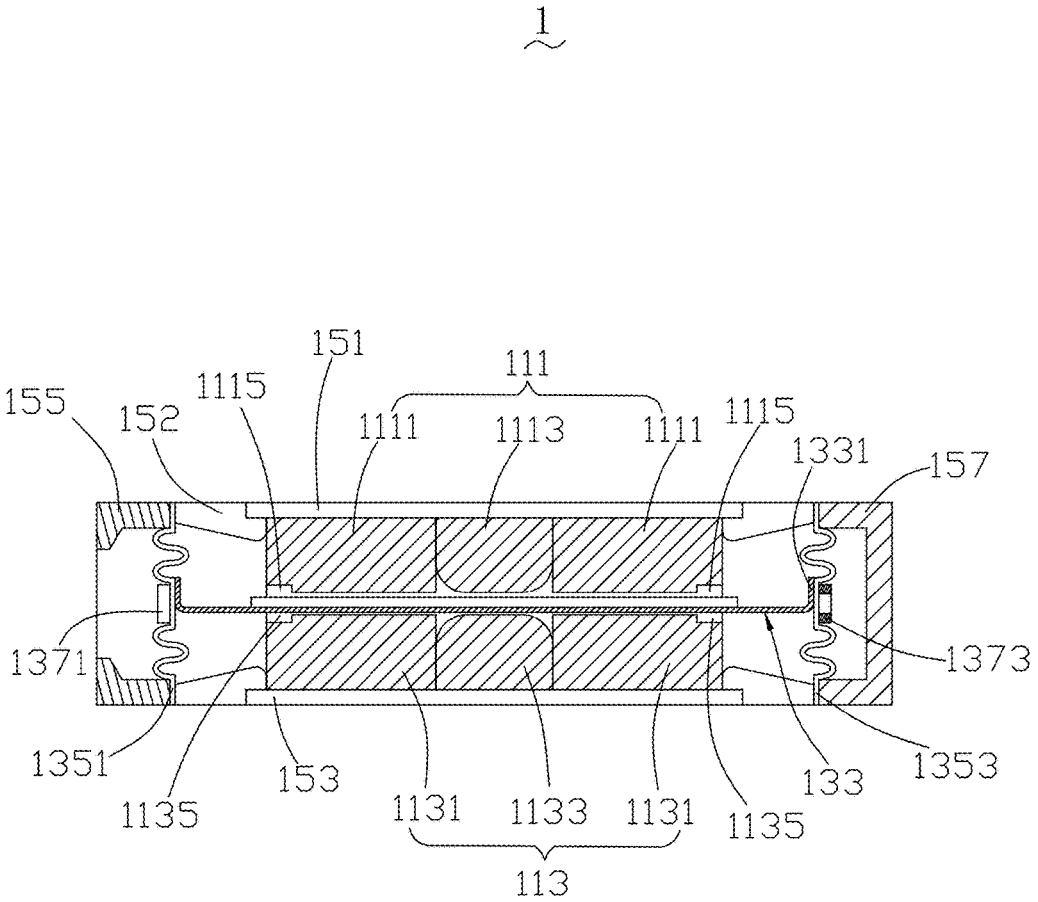
FIG. 5 is a cross-sectional view of the speaker of FIG. 1.

Referring also to FIG. 5, the vibrating system 13 includes a coil 131, a coil support 133, a membrane module 135 and a dome module 137. The membrane module 135 includes a first membrane 1351 and a second membrane 1353, which may serve as a front membrane and a rear membrane and are arranged at the front opening and the rear opening of the main frame 152 respectively. The dome module 137 comprises a front dome 1371 attached on a front surface of the first membrane 1351 and facing the front cover 155, and a rear dome 1373 attached on a rear surface of the second membrane 1353 and facing the rear cover 157.

The coil 131 and the coil support 133 cooperatively form a coil assembly, which serves as a vibration driving module for driving the membrane module 135 to vibrate and produce audible sound. The coil assembly is located in a magnetic gap provided by the magnetic system 11, and is connected between the first membrane 1351 and the second membrane 1353. Moreover, the coil assembly is arranged in a plane perpendicular to the vibration direction of the first membrane 1351 and the second membrane 1353.

The coil 131 may be an oblate ring-shaped coil formed by a plurality of conductive wires, which is positioned in the magnetic gap of the magnetic system 11 to obtain a long stroke. The coil support 133 is configured for supporting and fixing the coil 131, and transferring motion of the coil 131 to the first membrane 1351 and the second membrane 1353. The coil support 133 includes a main body which may be a rectangular ring-shaped plate for fixing the coil 131, and a pair of extending parts 1331 extending perpendicularly from two opposite edges of the main body respectively. The pair of extending parts 1331 is respectively connected to and abuts against the first membrane 1351 and the second membrane 1353 respectively.

In the present embodiment, each of the extending parts 1331 may be an elongated piece extending from the entire edge of the main body; moreover, the main body and the extending parts 1331 may be integrated into a one-piece structure to enhance an intensity of the coil support 133 and protect the coil 131 thereon from suffering undesired distortion.

Furthermore, the coil support 133 may be made of material with light and rigid characteristics; for example, the coil support 133 may be made of aluminum alloy, which can improve an electro-acoustic converting efficiency of the speaker 1, as well as a rigidity of the coil support 133 to ensure stability of the coil 131. In other embodiments, the material of the coil support may alternatively be any one selected from magnesium alloy, stainless steel, plastic, and carbon fiber composite.

The first membrane 1351 includes a first flat part located at a main central region thereof, and a first wrinkling part surrounding the first flat part. The first wrinkling part has a wavy cross section, which enables the first membrane 1351 to have a greater vibrating amplitude. One of the extending parts 1331 of the coil support 133 abuts against the first flat part, and is located at a different side of the first flat part from the front dome 1371. The second membrane 1353 may have a configuration similar to that of the first membrane 1351, and is arranged substantially symmetrical with the first membrane 1351 about the magnetic system 11. The second membrane 1353 includes a second flat part located at a main central region thereof, and a second wrinkling part surrounding the second flat part. The other one of the extending parts 1331 of the coil support 133 abuts against the second flat part, and is located at a different side of the second flat part from the rear dome 1373. The extending parts 1331 can expand a contact area between the coil support 133 and the membrane module 133 and thus enhance a rigidity of the membrane module 133.

Furthermore, the second membrane 1353 may differ from the first membrane 1351 in that the second flat part includes a plurality of air holes; the plurality of air holes may be arranged in a line and are communicated with the receiving cavity of the main frame 152. The rear dome 1373 may further include a plurality of through holes corresponding to the air holes of the second membrane respectively; the plurality of through holes may be aligned with the air holes, and have a shape and a size substantially same as the air holes. The front dome 1371 and the rear dome 1373 can further enhance the rigidity of the membrane module 135 and thereby improving a sound effect of the speaker 1.

The magnetic system 11 includes a first magnet module 111 and a second magnet module 113 opposite to and apart from each other to form the magnetic gap for receiving the coil assembly. In the present embodiment, the magnetic system 11 merely arranged at two opposite sides of the coil assembly, as illustrated in FIG. 5.

Figure 3:
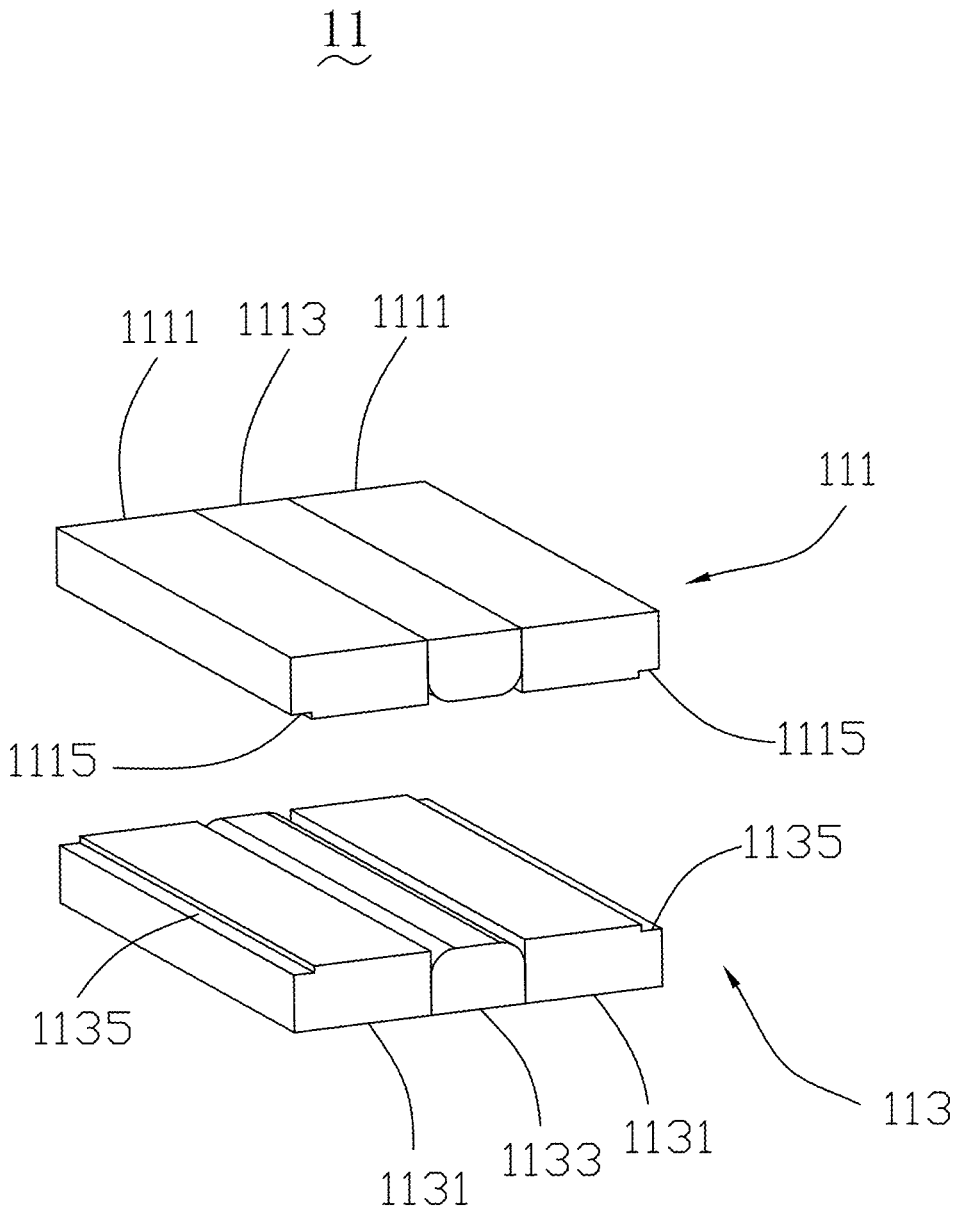
FIG. 3 is a schematic view of a magnetic system of the speaker of FIG. 1.

Referring also to FIG. 3, the first magnet module 111 includes two first main magnets 1111 parallel to each other and a first secondary magnet 1113 arranged between the two first main magnets 1111. The first secondary magnet 1113 is parallel to the two first main magnets 1111, and abuts against the two first main magnets 1111 to form a one-piece magnet module. The second magnet module 113 includes two second main magnets 1131 parallel to each other and a second secondary magnet 1133 arranged between the two second main magnets 1131. The second secondary magnet 1113 is parallel to the two second main magnets 1131, and also abuts against the two main magnets 1111 to form a one-piece magnet module.

Moreover, the first magnet module 111 further includes a pair of first grooves 1115 formed at two opposite ends thereof, and the second magnet module 113 further includes a pair of second grooves 1135 formed at two opposite ends thereof; both the first grooves 1115 and the second grooves 115 are step-shaped grooves facing the coil assembly.

In particular, one of the first grooves 1115 is formed at an edge of a first main magnet 1111 adjacent to the first membrane 1351, and the other one of the first grooves 1115 is formed at an edge of the other first main magnet 1111 adjacent to the second membrane 1353. One of the second grooves 1135 is formed at an edge of a second main magnet 1131 adjacent to the first membrane 1351, and the other one of the second grooves 1135 is formed at an edge of the other second main magnet 1131 adjacent to the second membrane 1353. In addition, each of the first grooves 1115 faces and is aligned with a respective one of the second groove 1135.

With the first grooves 1115 and the second grooves 1135, two ends of the magnetic gap both has a width greater than other portions of the magnetic gap, that is, the first grooves 1115 and the second grooves 1135 can provide an extra space in the magnetic gap. Moreover, in operation, the coil 131 may receive an electric driving current and motion in the magnetic gap, and the coil support 133 is driven to transfer the motion of the coil 131 to the membrane module 135; during an operation of the coil support 133, the two extending part 1331 thereof may be inserted into the first grooves 1115 and the second grooves 1135; in other words, a motion range of the coil support 133 can be increased due to the first grooves 1115 and the second grooves 1135. Therefore, the coil support 133 can obtain a sufficient motion range with a short length, and an overall size of the speaker 1 can be lessened to meet miniaturization requirement of a mobile device. Furthermore, the first grooves 1115 and the second grooves 1135 can also increase a magnetic field efficiency of the magnetic system 11; this may further enable the speaker 1 to obtain a linear BL relation line and decrease distortion due to a non-linear BL relation.

It should be noted that the above description is merely one of optional configurations of the magnetic system 11, in practice, the first grooves 1115 and the second grooves 1135 can also be formed at other regions of the first magnet module 111 and the second magnet module 113.

Figure 4:
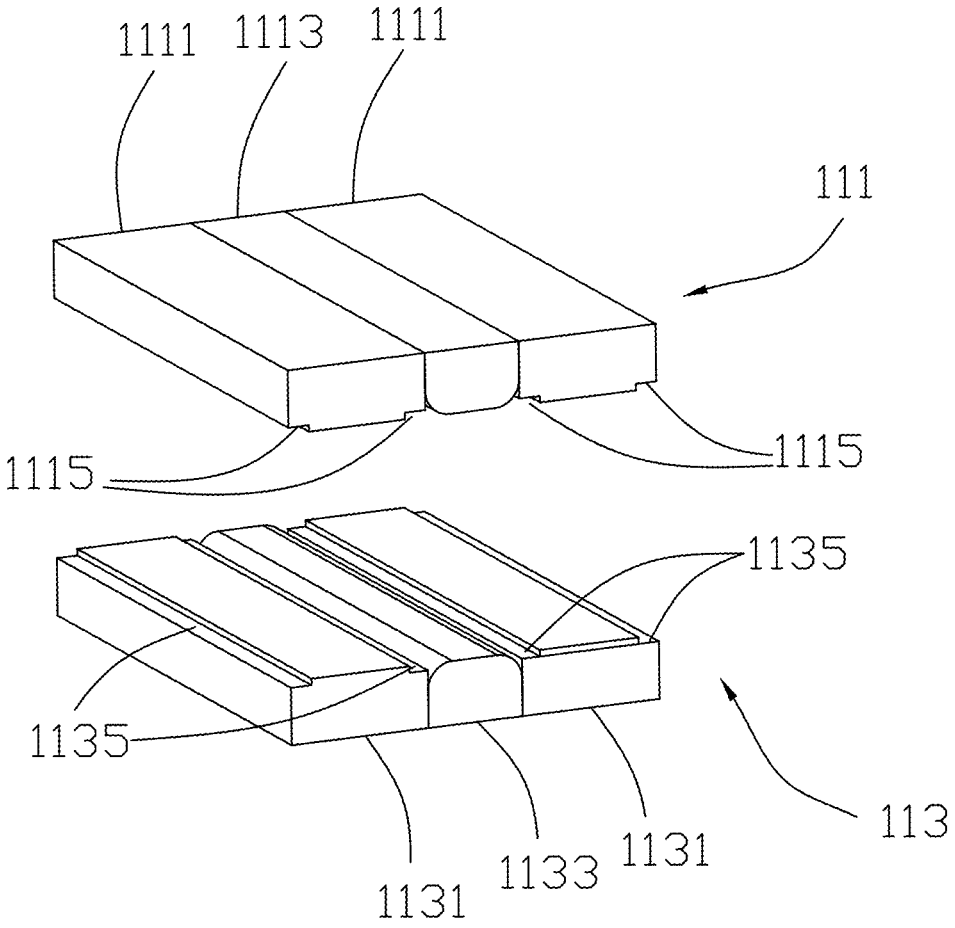

For example, in an alternative embodiments as illustrated in FIG. 4, the first magnet module 111 may further include two more first grooves 1115, each of which is formed at an edge of the first main magnets 1111 adjacent to the first secondary magnet 1113, and the second magnet module 113 may further includes two more second groove 1135, each of which is formed at an edge of the second main magnets 1131 adjacent to the second secondary magnet 1133. In other words, each of the first main magnets 111 has a pair of first grooves 1115 formed at two opposite edges thereof, and each of the second magnets 113 has a pair of second grooves 1135 formed at two opposite edges thereof. Furthermore, in other embodiment, the first secondary magnet 1113 and the second secondary 1133 can be chamfered to formed two curved edges.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell;

a magnetic system received in the shell, and comprising a first magnet module and a second magnet module opposite to each other for forming a magnetic gap; and a vibrating system received in the shell, and comprising a membrane module and a coil assembly arranged in the magnetic gap;

wherein, the coil assembly is connected to the membrane module for driving the membrane module to vibrate, and comprises a coil and a coil support for supporting the coil, the first magnet module comprises a pair of first grooves formed at two opposite edges thereof, the first grooves are adjacent to the membrane module and face the coil assembly; and wherein, the second magnet module comprises a pair of second grooves formed at two opposite edge thereof; the pair of second grooves faces the coil assembly and is aligned with the pair of first grooves of the first magnet module;

wherein, each of the first magnet module and the second magnet module comprises two main magnets parallel to each other and a secondary magnet arranged between the two main magnets, the first grooves and the second grooves are respectively formed at the main magnets of the first magnet module and the second magnet module.

2. The speaker of claim 1, wherein the first grooves and the second grooves are step-shaped grooves.

3. The speaker of claim 1, wherein the first magnet module further comprises two more first grooves formed at the two main magnets of the first magnet module and adjacent to the secondary magnet of the first magnet module; the second magnet module further comprises two more second grooves formed at the two main magnets of the second magnet module and adjacent to the secondary magnet of the second magnet module.

4. The speaker of claim 1, wherein the coil support comprises a main body for supporting the coil and a pair of extending parts perpendicularly extending from two opposite ends of the main body.

5. The speaker of claim 4, wherein the first grooves and the second grooves are configured for providing an extra space for motion of the extending parts of the coil support in operation, and the extending parts of the coil support are insertable into at least one of the first grooves and the second grooves.

6. The speaker of claim 4, wherein the membrane module comprises a first membrane and a second membrane located at two opposite sides of the coil assembly, and the pair of extending parts of the coil support is connected to the first membrane and the second membrane respectively.

7. The speaker of claim 6, wherein the first membrane comprises a first flat part and a first wrinkling part surrounding the first flat part, one of the extending parts of the coil support abuts against the first flat part of the first membrane.

8. The speaker of claim 7, wherein the second membrane comprises a second flat part and a second wrinkling part surrounding the second flat part, the other one of the extending parts of the coil support abuts against the second flat part of the second membrane.

9. The speaker of claim 8, wherein the vibrating system further comprises a first dome attached on the first flat part of the first membrane, and a second dome attached on the second flat part of the second membrane.

10. The speaker of claim 9, wherein the second membrane further comprises a plurality of air holes formed at the second flat part thereof, and the second dome comprise a plurality of through holes aligned with the air holes of the second membrane.

11. The speaker of claim 6, wherein the shell comprises a main frame with a front opening and a rear opening, the first membrane and the second membrane are respectively arranged at the front opening and the rear opening of the main frame.

12. The speaker of claim 11, wherein the shell further comprises a front cover and a rear cover, the front cover and the rear cover are engaged with the main frame for covering the front opening and the rear opening, the front cover comprises a sound outlet facing the front opening.

13. The speaker of claim 11, wherein the main frame further comprises a top opening and a bottom opening, and the shell further comprises a top cover plate and a bottom cover plate for covering the top opening and the bottom opening respectively.

14. The speaker of claim 11, wherein the top cover plate and the bottom cover plate are detachable from the main frame.

* * * * *